US006834928B2

(12) United States Patent
Rio Doval et al.

(10) Patent No.: US 6,834,928 B2
(45) Date of Patent: Dec. 28, 2004

(54) DETERMINATION OF MEDIA ADVANCEMENT BASED ON ONE PIXEL-WIDE MEDIA IMAGES

(75) Inventors: Jose M Rio Doval, Barcelona (ES); Carles Flotats, Barcelona (ES); David Claramunt, Barcelona (ES); Marc Jansa, Barcelona (ES); Francesc Subirada, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 51 days.

(21) Appl. No.: 10/419,322

(22) Filed: Apr. 19, 2003

(65) Prior Publication Data

US 2004/0207672 A1 Oct. 21, 2004

(51) Int. Cl.[7] ..... B41J 29/38; B41J 29/393
(52) U.S. Cl. ..... 347/16; 347/19
(58) Field of Search ..... 347/5, 16, 19, 347/37, 14, 40, 41

(56) References Cited

U.S. PATENT DOCUMENTS

| | | | | |
|---|---|---|---|---|
| 4,630,813 A | | 12/1986 | Watanabe et al. | |
| 5,349,375 A | * | 9/1994 | Bolash et al. | 347/40 |
| 5,416,307 A | | 5/1995 | Danek et al. | |
| 5,635,726 A | | 6/1997 | Zavislan et al. | |
| 5,923,042 A | * | 7/1999 | Mietta et al. | 250/559.06 |
| 6,118,832 A | | 9/2000 | Mayrargue et al. | |
| 6,447,089 B1 | | 9/2002 | Arquilevich et al. | |

* cited by examiner

*Primary Examiner*—Thinh Nguyen

(57) ABSTRACT

A method of an embodiment of the invention is disclosed in which a linear imaging array captures a first one pixel-wide image of media, and the media is effectively advanced relative to the linear imaging array. The linear imaging array captures a second one pixel-wide image of the media, and the first and the second one pixel-wide images are compared to determine relative advancement of the media.

36 Claims, 5 Drawing Sheets

CONTROLLER
116
114
100
104
106
112
102A
102B
102N
108A
108B
108N
110A
110B
110N

DETERMINATION OF MEDIA ADVANCEMENT BASED ON ONE PIXEL-WIDE MEDIA IMAGES

BACKGROUND

Image-forming devices are frequently used to form images on media, such as paper and other types of media. Image-forming devices include laser printers, inkjet printers, and other types of printers and other types of image-forming devices. Media is commonly moved through an image-forming device as the device forms the image on the media. The image-forming mechanism of the device, such as an inkjet-printing mechanism, may move in a direction perpendicular to that in which the media moves through the image-forming device. Alternatively, the image-forming mechanism may remain in place while the media moves past it.

For high-quality image formation, the movement of the media through an image-forming device is desirably precisely controlled. If the media moves more than intended, there may be gaps in the resulting image formed on the media, whereas if the media moves less than intended, there may be areas of overlap in the resulting image. A media-advance sensor can be used to measure media advancement. However, high-quality media-advance sensors can be expensive, rendering their inclusion in lower-cost and mid-cost image-forming devices prohibitive. Less accurate and less costly sensors may be used, but they may provide less than desired sensing capabilities.

SUMMARY OF THE INVENTION

In a method of an embodiment of the invention, a linear imaging array captures a first one pixel-wide image of media, and the media is effectively advanced relative to the linear imaging array. The linear imaging array captures a second one pixel-wide image of the media, and the first and the second one pixel-wide images are compared to determine relative advancement of the media.

BRIEF DESCRIPTION OF THE DRAWINGS

The drawings referenced herein form a part of the specification. Features shown in the drawing are meant as illustrative of only some embodiments of the invention, and not of all embodiments of the invention, unless explicitly indicated, and implications to the contrary are otherwise not to be made.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Media-advance Sensor having Linear Imaging Array

Figure 1:
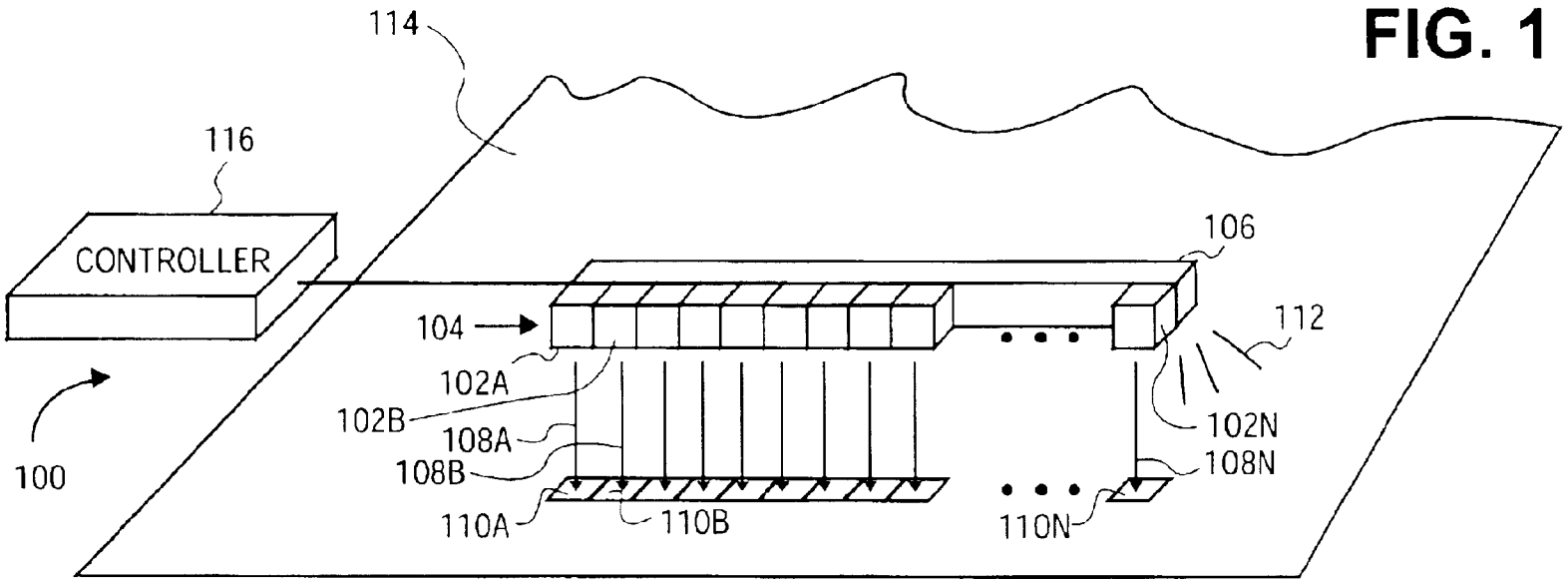
FIG. 1 is a diagram of a media-advance sensor having a linear imaging array, according to an embodiment of the invention.

FIG. 1 shows a media-advance sensor 100, according to an embodiment of the invention. The media-advance sensor 100 includes a linear imaging array 104 and an illumination mechanism 106. The media-advance sensor 100 may also include a controller 116. The linear imaging array 104 is made up of a number of linearly organized one-pixel imaging elements 102A, 102B, . . . , 102N, collectively referred to as the one-pixel imaging elements 102. Because the imaging elements 102 are linearly organized, the linear imaging array 104 is one pixel in width, and a number of pixels in length. That is, the linear imaging array 104 is a 1×n linear imaging array. There may be tens, hundreds, thousands, or more of the one-pixel imaging elements 102, depending on the desired accuracy of the media-advance sensor 100 in determining advancement of media 114, and/or the relative speed of the media 114. Each of the imaging elements 102 corresponds to a single pixel, and may be, for instance, a charge-coupled device (CCD), a complementary metal-oxide semiconductor (CMOS) imaging sensor, or another type of optical sensor.

The linear imaging array 104 is positioned relative to the media 114, such as paper or another type of media. An optics stage, having a single lens, a group of lenses, or other optical devices may also be added to modify the field of view of the sensor and/or the magnification, as can be appreciated by those of ordinary skill within the art. At designated intervals, the linear imaging array 104 captures a one-pixel wide image of the media 114. Each of the imaging elements 102 captures a corresponding one pixel-by-one pixel image of the media 114. The imaging element 102A captures a one-pixel square image of the media portion 110A, as indicated by the arrow 108A, the element 102B captures an image of the media portion 110B, as indicated by the arrow 108B, and so on, through the element 102N capturing an image of the media portion 110N, as indicated by the arrow 108N. The image may alternatively be a rectangular one-pixel image, or a different type of one-pixel image. The media portions 110A, 110B, . . . , 110N are collectively referred to as the media portions 110.

The captured image is a description of the properties of the corresponding media portion 110, such as the amount of light received from this media portion 110. This amount of light received by each one of the imaging elements 102 depends on the inherent physical aspects or attributes of the media 114, such as paper fibers and strands where the media 114 is paper, or on previously applied markings to the media 114. For instance, if the sensor 100 whose imaging elements 102 provide a value, either a digital value or an analog value, corresponding to the amount of light received from the corresponding media portion 110, the first image may be described by the sequence of values $I_{FIRST}=\{a_0, a_1, \ldots a_N\}$. Each of the $a_i$ values corresponds to the value supplied by the corresponding of the imaging elements 102 at the time when the first image was captured. Similarly, the second image may be described as $I_{SECOND}=\{b_0, b_1, \ldots b_N\}$, where each of the $b_i$ values corresponds to the value supplied by the corresponding of the imaging elements 102 at the time instant when the second image was captured.

Preferably, the illumination mechanism 106 provides a uniform amount of collimated light to illuminates the media portions 110, while the imaging elements 102 are capturing images, as indicated by the rays 112. The illuminating mechanism 106 may include a number of light-emitting diodes (LED's) equal to the number of the elements 102, a different number of LED's, or one or more of another type of illuminating mechanism. Under such illumination conditions, the image for any specific of the media portions 110, captured by the successive imaging elements 102 as the media moves underneath the sensor, is essentially the same and independent of which of the imaging elements 102 is used to capture it.

The controller 116 may be software, hardware, or a combination of software and hardware. Where it is integral to the media-advance sensor 100 itself, the controller 116 is preferably hardware. The controller 116 causes the linear imaging array 104 to capture one pixel-wide images, such as in response to an external signal, which may be provided by an encoder or another type of predictor, or at calculated time intervals. The controller 116 can cause the linear imaging array 104 to capture a series of successive images of the media 114 as the media 114 moves along the length of the linear imaging array 104. Each rolling pair of such images includes a before media advancement image and an after media advancement image. The controller 116 can compare the before and the after images to determine the relative advancement of the media 114 to the linear imaging array 104, as is described in more detail in the next sub-section of the detailed description.

Figure 2A:
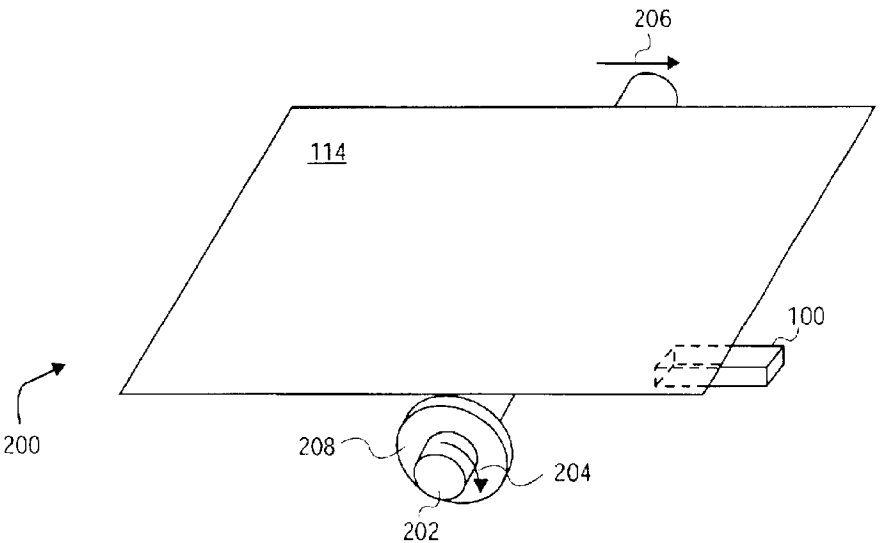
FIG. 2A is a diagram of a media-advancing mechanism relative to which the media-advance sensor of FIG. 1 is situated, according to an embodiment of the invention.

FIG. 2A shows a media-advancing mechanism 200 relative to which the media-advance sensor 100 is situated, according to an embodiment of the invention. The media-advancing mechanism 200 specifically includes a roller 202 that rotates in the direction indicated by the arrow 204. As a result of friction between the media 114 and the roller 202, the media 114 advances in the direction indicated by the arrow 206. This causes the media 114 to travel over the media-advance sensor 100, which is stationary. The media-advance sensor 100 is positioned length-wise relative to advancement of the media 114. As a result, the media-advance sensor 100 is utilized to determine how much the media 114 advances between when a first image is captured by the sensor 100 and when a second image is captured by the sensor 100.

Figure 2B:
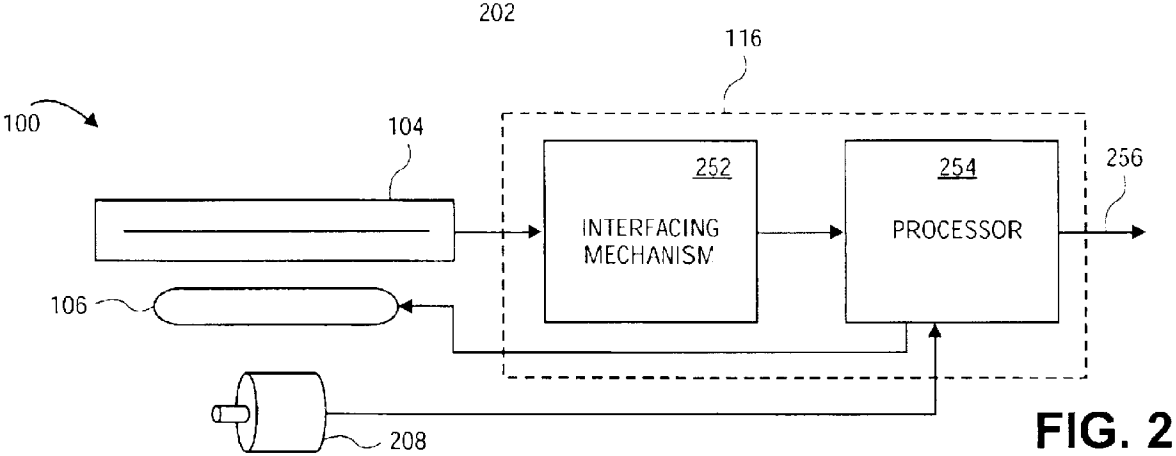
FIG. 2B is a diagram of a portion of the media-advance sensor of FIG. 1 in more detail, according to an embodiment of the invention.

FIG. 2B shows a portion of the media-advance sensor 100 in more detail, according to an embodiment of the invention. The controller 116 is depicted as including an interfacing mechanism 252 for the linear imaging array 104, as well as a processor 254. Where the array 104 includes CCD sensors, the interfacing mechanism 252 may be an analog front end for the sensors. Where the array 104 includes CMOS sensors, the interfacing mechanism 252 may be a digital interface block. Based on information received from the encoder wheel 208, the processor 254 turns on the illumination mechanism 106, and retrieves the image captured by the linear imaging array 104, through the interfacing mechanism 252. This information is then provided for purposes of comparison to a previously captured image, and so on, as indicated by the arrow 256.

Figure 3:
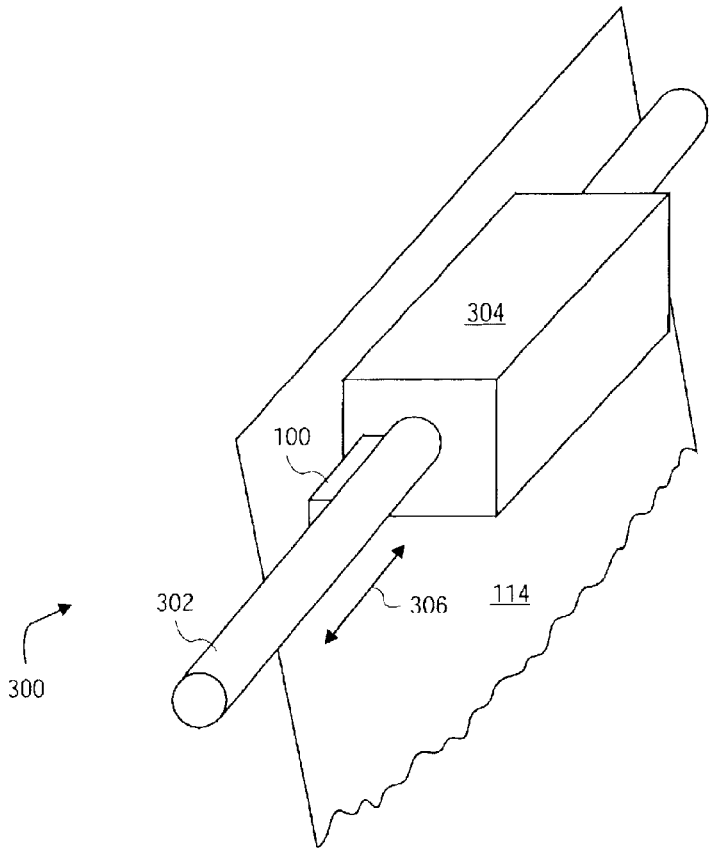
FIG. 3 is a diagram of an image-forming mechanism relative to which the media-advance sensor of FIG. 1 is situated, according to an embodiment of the invention.

FIG. 3 shows an image-forming mechanism 300 relative to which the media-advance sensor 100 is situated, according to an embodiment of the invention. The image-forming mechanism 300 includes a carriage shaft 302 along which a printhead 304 and the media-advance sensor 100 move back and forth, as indicated by the arrows 306. The printhead 304 may be an inkjet printhead, such that the image-forming mechanism 300 is an inkjet-printing mechanism. The printhead 304 may also be another type of printhead. The media 114 preferably is stationary while the printhead 304 is moving across the media 114 and ejecting ink onto the media 114. The media-advance sensor 100 correspondingly moves over the media 114 while the media 114 is stationary, although the media 114 can be considered to be moving relative to the sensor 100. The sensor 100 is positioned length-wise relative to its movement over the media 114. The sensor 100 is utilized to determine how much the media 114 has relatively moved between when a first image is captured and when a second image is captured by the sensor 100.

Using Linear Imaging Array to Determine Media Advancement

Figure 4:
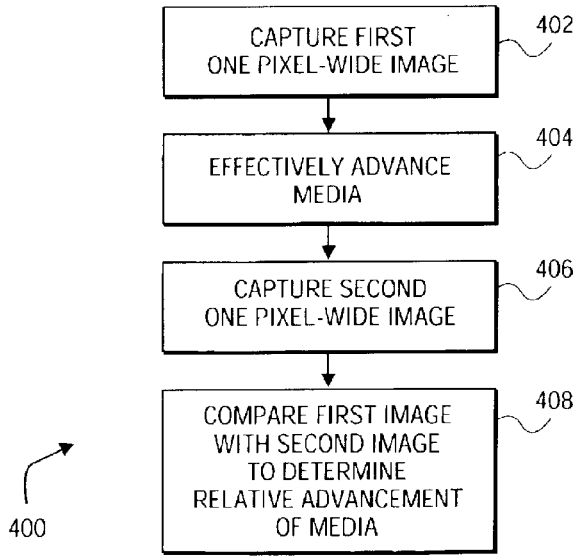
FIG. 4 is a method for determining media advancement using a linear imaging array, according to an embodiment of the invention.

FIG. 4 shows a method 400 for using a linear imaging array to determine the relative advancement of media, according to an embodiment of the invention. The linear imaging array may be the linear imaging array 104 of FIG. 1 that has been described. A first one pixel-wide image of the media is captured by the linear imaging array (402). The image may be of the inherent physical aspects or attributes of the media, such as paper fibers and strands where the media is paper. Alternatively, the image may be of previously applied markings to the media, as is described in more detail in the next section of the detailed description.

The media is effectively advanced relative to the linear imaging array (404). For instance, the linear imaging array may be stationary and the media may actually move, as is the case with the media-advancing mechanism 200 of FIG. 2A that has been described. Alternatively, the linear imaging array may actually move while and the media may be stationary, as is the case with the image-forming mechanism 300 of FIG. 3 that has been described. A second one pixel-wide image of the media is then captured by the linear imaging array (406). Like the first image, the second image may be of the inherent physical aspects of the media, of previously applied markings to the media, and so on. The image acquisition is repeated at a rate that ensures sufficient image overlap.

The first image is finally compared with the second image to determine the relative advancement of the media (408).

Considering the image overlap that has been mentioned, the two images will have a number of pixels in common, where these common pixels have shifted from the first image to the second image. Determining the shift of these pixels effectively determines the relative advancement of the media, where the size of each pixel is known in advance. More generally, as can be appreciated by those of ordinary skill within the art. the first and the second images are correlated with one another.

That is, as can be appreciated by those of ordinary skill within the art, a correlation between the second image and a shifted version of the first image is calculated. In each iteration, the first image is shifted one pixel and a correlation coefficient is calculated. The process is repeated for a new shift value to obtain a set of correlation coefficients. Each of the correlation coefficients is a measure of how similar is one of the images and a shifted version of the other image. It is noted that either the first image may be shifted, or the second image may be shifted. Different approaches to determine the correlation coefficient can be used.

An example of an approach that may be used to determine the correlation coefficient is to employ the following expression:

$$C_n = \sum_{i=0}^{j} |b_{k+i} - a_{k+i-n}|^x$$

The values a and b are the image values, as has been described, and n is the shift between the two images in number of pixels. Once the set of correlation coefficients, $C_n$, has been calculated, the best correlation is found. Depending on how the correlation coefficient is obtained, either the maximum or the minimum value is then determined.

For instance, if the expression showed above is used, the best correlation between the two images is found for the n value whose associated coefficient, $C_n$, is minimum. When the media displacement does not correspond to an integral number of pixels, the best correlation between the two images corresponds to a fractional value of n. For instance, the set of correlation coefficients, $C_n$, for the different shift values can be interpolated, using any known interpolation technique, to obtain a curve whose minimum or maximum corresponds to the non-integral shift occurring between the first and the second images and thus to the corresponding media advancement.

To minimize the computation time, only a subset of the image may be correlated. Given the nature of most image sensors, a full image is obtained every time the sensor is read. A subset of the total number of pixels, preferably a set of adjacent ones, is considered the first image. This implies that only a subset of the second image, of the same size that the first image, is used to "search" the first image—that is, to determine the correlation coefficients. When a single full image is acquired, the subset of pixels comprising the first image is stored. During the next iteration, both the stored first image and the current image are used to compute the correlation coefficients, while the current subset of pixels comprising the first image is stored to compute the coefficients during the next iteration.

To further reduce the computation time, the information supplied by the predictor, such as the encoder wheel 208 of FIG. 2B, or another device, or a reasonable estimation of the media advance speed, may be used to determine a rough estimation of the actual media advance. This rough estimation is used as the starting point for the calculation of the correlation coefficients. Depending on the accuracy of the prediction, fewer images may need to be correlated to calculate the shift between the two images.

Figure 5:
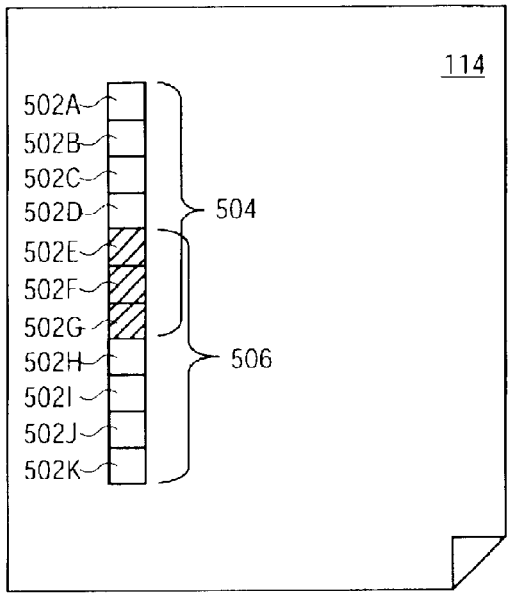
FIG. 5 is a diagram showing an illustrative example performance of the method of FIG. 4, according to an embodiment of the invention.

FIG. 5 shows a simplified example of the performance of the method 400 of FIG. 4 relative to the media 114, according to an embodiment of the invention. The example of FIG. 5 presumes a seven pixel-long linear imaging array for illustrative clarity. The linear imaging array captures a first image 504 of the media 114, which includes the pixels 502A, 502B, 502C, 502D, 502E, 502F, and 502G. After the media 14 has been advanced, the linear imaging array captures a second image 506 of the media 114, which includes the pixels 502E, 502F, 502G, 502H, 502I, 502J, and 502K.

Hence, the shaded pixels 502E, 502F, and 502G are common to both the first image 504 and the second image 506. The shaded pixels 502E, 502F, and 502G occupy the fifth through seventh pixel positions of the first image 504, whereas they occupy the first through third pixel positions of the second image 506. This means that the media 114 has been advanced by an amount equal to four pixels. Where each pixel may be equal to ten micron, for instance, the media has therefore advanced forty micron. Thus, the images captured by the linear imaging array are used to measure media advancement.

Accommodating Media Skew When Determining Media Advancement

The capture of images of inherent physical media aspects or attributes to determine media advancement with a linear imaging array can be accomplished when there is little or no media skew. Media skew is defined as unwanted relative movement of the media in a direction perpendicular to the direction of desired relative media movement. For example, where the media is moving longitudinally across the length of the linear imaging array, lateral movement of the media across the width of the linear imaging array is media skew.

Figure 6:
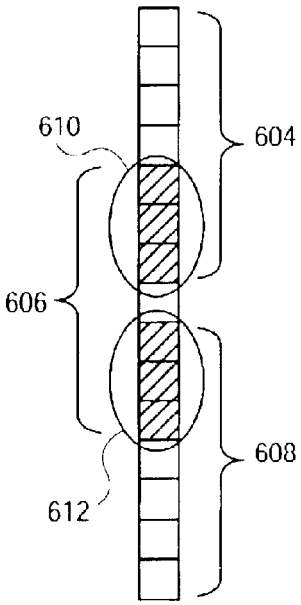
FIG. 6 is a diagram illustrating media advancement and detection thereof with no media skew, according to an embodiment of the invention.

FIG. 6 shows the utilization of images captured by a linear imaging array without media skew, according to an embodiment of the invention. There are three successively captured images 604, 606, and 608. The images 604 and 606 have the pixels 610 in common, whereas the images 606 and 608 have the pixels 612 in common, since there is no lateral, or left-to-right, media skew. The identification of the shift of the pixels 610 from the image 604 to the image 606, and the identification of the shift of the pixels 612 from the image 606 to the image 608, can be utilized to determine media advancement. Regardless of whether the images 604, 606, and 608 are of inherent physical media aspects or attributes, or of previously applied markings, because there are common pixels between the images 604 and 606, and between the images 606 and 608, media advancement can be determined therefrom.

Figure 7:
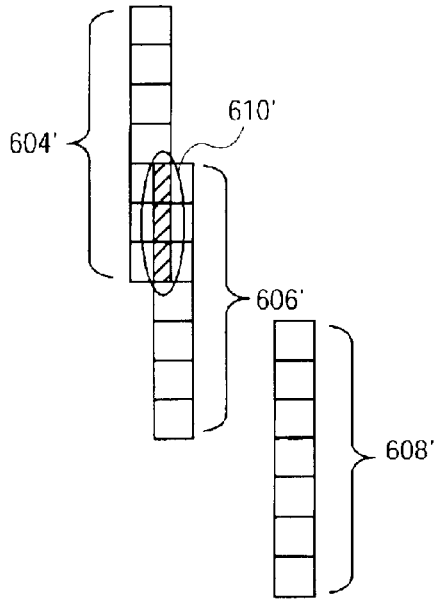
FIG. 7 is a diagram illustrating media advancement and detection thereof with media skew, according to an embodiment of the invention.

By comparison, FIG. 7 shows the utilization of images captured by a linear imaging array with media skew, according to an embodiment of the invention. Because of lateral, or left-to-right, movement of the media between when the image 604' is taken and when the image 606' is taken, the images 604' and 606' only share the partial pixels 610' in common. Further lateral movement of the media between when the image 606' is taken and when the image 608' is taken results in the images 608' and the images 610' not sharing any partial or complete pixels. Where the images 604', 606', and 608' are of inherent physical media aspects or attributes, the lack of substantially complete common pixels between the images 604' and 606', or between the images 606' and 608' , results in the inability to determine media advancement.

Figure 8:
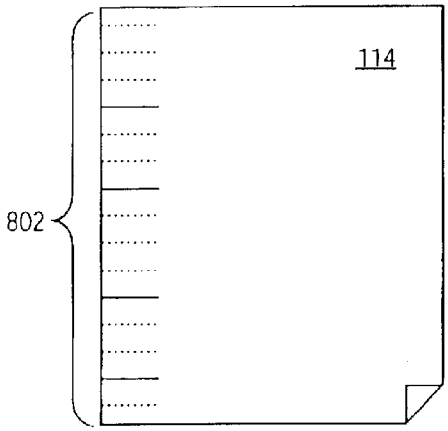
FIG. 8 is a diagram of media having markings applied thereto to provide for detection of media advancement even with media skew, according to an embodiment of the invention.

FIG. 8 shows the media 114 with markings 802 applied thereto to allow for media-advancement determination in the presence of media skew, according to an embodiment of the invention. The markings 802 are specifically depicted in FIG. 8 as horizontal lines that extend from the top of the media 114 to the bottom of the media 114 along the left side of the media 114. The horizontal lines have the following repeating pattern in FIG. 8: three dotted lines, followed by a solid line, followed by two dotted lines, followed by a solid line. Each horizontal line extends in length by more than one pixel. The markings 802 may be physical impressions applied to the media 114. They may also be ink, such as yellow ink, applied to the media 114. Preferably, the markings are as invisible as possible to the human eye, so as not to detract from the images being formed on the media 114 itself.

Figure 9:
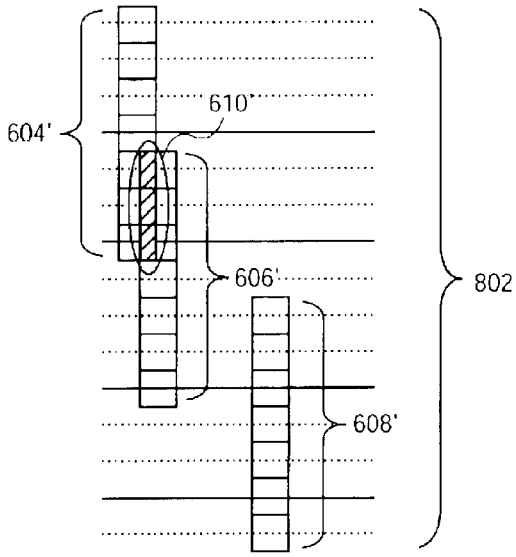
FIG. 9 is a diagram illustrating media advancement and detection thereof with media skew, where the media includes previously applied markings, according to an embodiment of the invention.

FIG. 9 shows the utilization of images of the markings 802 captured by a linear imaging array with media skew, according to an embodiment of the invention. The presence of the markings 802 enable media advancement to be determined, even in the presence of the lateral media skew. Rather than capturing images of the inherent physical aspects or attributes of the media, the linear imaging array captures images of the markings 802. Because the markings 802 each extend in length by more than one pixel, even in the presence of lateral skew there are shared pixels between two successive images, allowing for media advancement to be successfully measured, or determined.

For instance, whereas the partial pixels 610' shared between the images 604' and 606' may not allow for media advancement to be determined where the images 604' and 606' are of physical media aspects, those of the markings 802 that extend across the partial pixels 610' allow for advancement to be determined where the images 604' and 606' are of the markings 802. This is because those of the markings 802 that extend across the partial pixels 610' can be correlated between the images 604' and 606', to determine how many pixels such common of the markings 802 have shifted in between when the image 604' was captured and when the image 606' was captured. Those of the markings 802 extending between both the pixels of the image 606' and the pixels of the image 608' similarly allow for media advancement to be determined.

Image-forming Device and Conclusion

Figure 10:
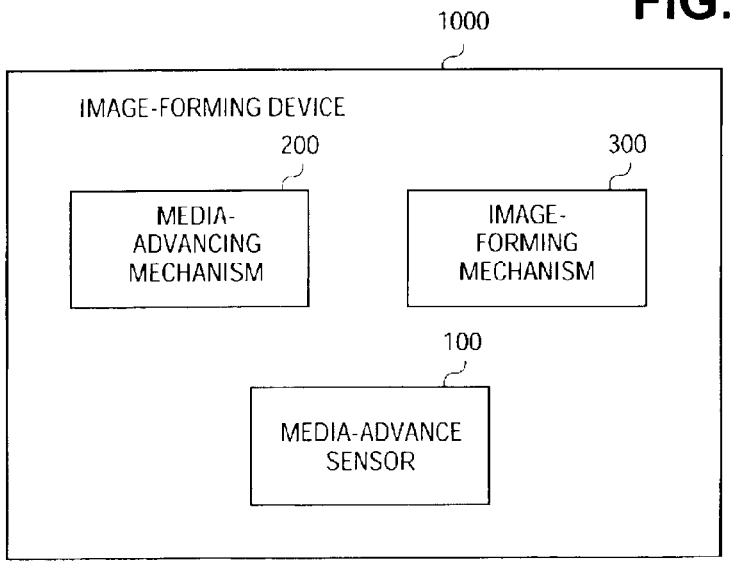
FIG. 10 is a diagram of an image-forming device, according to an embodiment of the invention.

FIG. 10 shows a block diagram of an image-forming device 1000, according to an embodiment of the invention. The image-forming device 1000 includes the media-advancing mechanism 200, the image-forming mechanism 300, and the media-advance sensor 100. As can be appreciated by those of ordinary skill within the art, the image-forming device 1000 depicted in FIG. 10 is generalized, and may and typically does include components in addition to and/or in lieu of those denoted in FIG. 10.

The media-advancing mechanism 200 advances media through the image-forming device 1000, whereas the image-forming mechanism 300 forms an image on the media as the media is advanced by the media-advancing mechanism 200. The media-advancing mechanism 200 may be that of FIG. 2A as has been described, whereas the image-forming mechanism 300 may be that of FIG. 3 as has been described. The media-advance sensor 100 determines the amount of media advancement that has occurred during designated intervals, as has been described.

It is noted that, although specific embodiments have been illustrated and described herein, it will be appreciated by those of ordinary skill in the art that any arrangement that is calculated to achieve the same purpose may be substituted for the specific embodiments shown. Other applications and uses of embodiments of the invention, besides those described herein, are amenable to at least some embodiments. For example, embodiments of the invention have been primarily described in relation to capturing and comparing first and second one pixel-wide images to determine the relative advancement of media, such as paper, within an image-forming device, between when the first image was captured and when the second image was captured. However, not all such embodiments are so limited.

As one example, for instance, an alternative embodiment of the invention may be utilized in conjunction with an optical pointing device, such as a mouse, trackball, or another type of optical pointing device. That is, first and second one pixel-wide images may be captured and compared to determine the relative movement of such a pointing device between when the first image was captured and when the second image was captured. Other alternative embodiments in which first and second one pixel-wide images may be captured and compared to determine relative movement between when the first image was captured and when the second image was captured may also be implemented. This application is intended to cover any adaptations or variations of the present invention. Therefore, it is manifestly intended that this invention be limited only by the claims and equivalents thereof.

We claim:

1. A method comprising:

capturing a first one pixel-wide image of media by a linear imaging array;

effectively advancing the media relative to the linear imaging array;

capturing a second one pixel-wide image of the media by the linear imaging array; and, comparing the first one pixel-wide image to the second one pixel-wide image to determine relative advancement of the media.

2. The method of claim 1, wherein capturing the first one pixel-wide image of the media comprises capturing the first one pixel-wide image of inherent physical aspects of the media.

3. The method of claim 2, wherein capturing the second one pixel-wide image of the media comprises capturing the second one pixel-wide image of the inherent physical aspects of the media.

4. The method of claim 1, wherein capturing the first one pixel-wide image of the media comprises capturing the first one pixel-wide image of previously applied markings on the media.

5. The method of claim 4, wherein capturing the second one pixel-wide image of the media comprises capturing the second one pixel-wide image of the previously applied markings on the media.

6. The method of claim 1, wherein effectively advancing the media relative to the linear imaging array comprises advancing the media past the linear imaging array.

7. The method of claim 1, wherein effectively advancing the media relative to the linear imaging array comprises advancing the linear imaging array past the media.

8. The method of claim 1, wherein capturing the second one pixel-wide image of the media comprises capturing the second one pixel-wide image as the first one pixel-wide image shifted one or more pixels.

9. The method of claim 1, wherein comparing the first one pixel-wide image to the second one pixel-wide image comprises determining a number of the one or more pixels by which the first one pixel-wide image shifted to result in the second one pixel-wide image.

10. The method of claim 1, wherein comparing the first one pixel-wide image to the second one pixel-wide image comprises correlating the first one-pixel wide image with the second one pixel-wide image.

11. A media-advance sensor for an image-formation device comprising:

a one pixel-wide linear imaging array to capture one pixel-wide images of media; and, an illumination mechanism to illuminate the media prior to capture of the one pixel-wide images of the media by the one pixel-wide linear imaging array.

12. The media-advance sensor of claim 11, further comprising a controller to cause the linear imaging array to capture before and after media advancement images and to compare the before and the after media advancement images to determine relative advancement of the media.

13. The media-advance sensor of claim 11, wherein the one pixel-wide linear imaging array comprises a 1×n pixel linear imaging array.

14. The media-advance sensor of claim 11, wherein the one pixel-wide linear imaging array comprises an array of charge-coupled devices (CCD's).

15. The media-advance sensor of claim 11, wherein the illumination mechanism illuminates the media uniformly.

16. The media-advance sensor of claim 11, wherein the illumination mechanism comprises one or more light-emitting diodes (LED's).

17. The media-advance sensor of claim 11, wherein the one pixel-wide linear imaging array has a pixel length based on at least one of a relative media advance speed of the image-formation device and a desired accuracy of media advance determination based on the one pixel-wide images captured by the one pixel-wide linear imaging array.

18. An image-forming device comprising:

a media-advancing mechanism to advance media;

an image-forming mechanism to form an image on the media as the media is advanced; and, a one pixel-wide media-advance sensing mechanism to measure advancement of the media as the media is advanced.

19. The image-forming device of claim 18, wherein the one pixel-wide media-advance sensing mechanism comprises a one pixel-wide linear imaging array to capture one pixel-wide images of the media.

20. The image-forming device of claim 19, wherein the one pixel-wide media-advance sensing mechanism further comprises an illumination mechanism to illuminate the media prior to capture of the one pixel-wide images by the one pixel-wide linear imaging array.

21. The image-forming device of claim 19, wherein the one pixel-wide media-advance sensing mechanism further comprises a controller to determine the advancement of the media based on the one pixel-wide images captured by the one pixel-wide linear imaging array.

22. The image-forming device of claim 19, wherein the one pixel-wide linear imaging array captures the one pixel-wide images of inherent physical aspects of the media.

23. The image-forming device of claim 19, wherein the one pixel-wide linear imaging array captures the one pixel-wide images of previously applied markings on the media.

24. The image-forming device of claim 19, wherein the one pixel-wide linear imaging array has a pixel length based on at least one of a media advance speed and a desired accuracy of media advance measurement based on the one pixel-wide images captured by the one pixel-wide linear imaging array.

25. An image-forming device comprising:

a media-advancing mechanism to advance media;

an image-forming mechanism to form an image on the media as the media is advanced; and, means for determining advancement of the media as the media is advanced based on captured one pixel-wide images of the media.

26. The image-forming device of claim 25, wherein the means comprises a 1×n pixel linear imaging array.

27. The image-forming device of claim 25, wherein the means comprises a plurality of charge-coupled devices (CCD's) organized one-pixel deep.

28. The image-forming device of claim 25, wherein the means compares a first one pixel-wide image of the media with a second one pixel-wide image of the media to determine the advancement of the media.

29. The image-forming device of claim 25, wherein the means correlates a first one pixel-wide image of the media with a second one pixel-wide image of the media to determine the advancement of the media.

30. The image-forming device of claim 25, wherein the means determines a number of one or more pixels by which a first one pixel-wide image of the media has shifted to result in a second one pixel-wide image of the media.

31. A method comprising:

capturing a first one pixel-wide image by a linear imaging array;

capturing a second one pixel-wide image by the linear imaging array; and, comparing the first one pixel-wide image to the second one pixel-wide image to determine relative movement that occurred between when the first one pixel-wide image was captured and when the second one pixel-wide image was captured.

32. The method of claim 31, wherein capturing the second one pixel-wide image comprises capturing the second one pixel-wide image as the first one pixel-wide image shifted one or more pixels.

33. The method of claim 31, wherein comparing the first one pixel-wide image to the second one pixel-wide image comprises determining a number of the one or more pixels by which the first one pixel-wide image shifted to result in the second one pixel-wide image.

34. The method of claim 31, wherein comparing the first one pixel-wide image to the second one pixel-wide image comprises correlating the first one-pixel wide image with the second one pixel-wide image.

35. The method of claim 31, wherein comparing the first one pixel-wide image to the second one pixel-wide image comprises comparing the first one pixel-wide image to the second one pixel-wide image to determine relative movement of a pointing device that occurred between when the first one pixel-wide image was captured and when the second one pixel-wide image was captured.

36. The method of claim 31, wherein comparing the first one pixel-wide image to the second one pixel-wide image comprises comparing the first one pixel-wide image to the second one pixel-wide image to determine relative movement of media that occurred between when the first one pixel-wide image was captured and when the second one pixel-wide image was captured.

* * * * *